US008585016B2

(12) United States Patent
Woolley et al.

(10) Patent No.: US 8,585,016 B2
(45) **Date of Patent: *Nov. 19, 2013**

(54) DEMOLITION TOOL

(75) Inventors: Christopher Woolley, Rocky Hill, CT (US); Michael Maruskiak, Manchester, CT (US); Joseph Martone, Bristol, CT (US); Eric Ranieri, Besancon (FR); Russell Powers, Newington, CT (US)

(73) Assignee: Stanley Black & Decker, Inc., New Britain, CT (US)

( * ) Notice: Subject to any disclaimer, the term of this patent is extended or adjusted under 35 U.S.C. 154(b) by 1064 days.

This patent is subject to a terminal disclaimer.

(21) Appl. No.: 12/233,715

(22) Filed: Sep. 19, 2008

(65) Prior Publication Data

US 2009/0008617 A1 Jan. 8, 2009

Related U.S. Application Data

(63) Continuation of application No. 11/391,230, filed on Mar. 29, 2006, now Pat. No. 8,117,702.

(51) Int. Cl.
*B66F 15/00* (2006.01)
*B25B 1/04* (2006.01)

(52) U.S. Cl.
USPC ..... 254/26 R; 7/146; 7/166

(58) Field of Classification Search
USPC ..... 254/19, 25, 26 R; 7/146, 147, 143, 144, 7/138–140, 166; 81/20, 25; D8/75, 81
See application file for complete search history.

(56) References Cited

U.S. PATENT DOCUMENTS

| | | | | |
|---|---|---|---|---|
| 37,920 | A | 3/1863 | Penny | |
| 89,013 | A | 4/1869 | Blake | |
| 292,168 | A | 1/1884 | Lytle | 7/138 |

(Continued)

FOREIGN PATENT DOCUMENTS

| | | |
|---|---|---|
| CA | 2296048 | 7/2001 |
| DE | 19937951 A1 | 3/2000 |

(Continued)

OTHER PUBLICATIONS

Examination Report issued for EP Patent Application No. 08158710.7, dated Mar. 10, 2010.

(Continued)

*Primary Examiner* — Hadi Shakeri
(74) *Attorney, Agent, or Firm* — Pillsbury Winthrop Shaw Pittman LLP

(57) ABSTRACT

The invention provides a demolition tool that can be used in many ways for the demolition of construction materials or other materials. The demolition tool includes a handle having a head at one end. The head has a longitudinal central plane that bisects the head, a strike contact face, and toothed, stepped grasping jaws that accommodate multiple sizes of lumber or other material. The head may also include a blunt blade edge below the strike contact face for striking and demolishing material. The demolition tool includes a bent end pry bar at a second end of the handle. The bent end pry bar being offset 90 degrees from the longitudinal central plane of the tool head enabling full range of motion without interfering with other tool functions. The demolition tool may comprise a single piece of material and may be softer than tools used to strike it, but harder than materials which it is used to strike.

15 Claims, 7 Drawing Sheets

(56) References Cited

U.S. PATENT DOCUMENTS

| | | | | |
|---|---|---|---|---|
| 439,336 | A | 10/1890 | Zitlow | |
| 486,300 | A | 11/1892 | Scheid | |
| 531,271 | A | 1/1894 | Matthews | |
| 563,848 | A | 7/1896 | Dunham | |
| D29,984 | S * | 1/1899 | Duffy | D8/81 |
| D30,322 | S * | 3/1899 | Austin | D8/81 |
| 711,408 | A * | 10/1902 | Maggard | 7/143 |
| 743,823 | A | 11/1903 | Bryar | |
| 845,975 | A | 3/1907 | Patterson | |
| 868,733 | A | 10/1907 | Walker | |
| 884,229 | A | 4/1908 | Sparks | |
| 914,199 | A | 3/1909 | Stiren | |
| 935,459 | A | 9/1909 | Carr | |
| 1,114,837 | A | 10/1914 | Wilson | |
| D55,792 | S | 7/1920 | Hudgins | |
| 1,469,472 | A | 11/1921 | Bangert | |
| 1,472,517 | A | 1/1922 | Fry | |
| 1,465,009 | A | 8/1923 | Wasseth | |
| 1,477,833 | A * | 12/1923 | Leak | 7/144 |
| 1,514,060 | A | 11/1924 | McCallum | |
| 1,613,729 | A | 1/1927 | Shearwood | |
| 1,689,685 | A | 10/1928 | Reeves | |
| 1,763,353 | A | 6/1930 | Heller | |
| 1,689,585 | A | 1/1935 | Haschart | |
| D120,609 | S | 5/1940 | Arnsbarger | D8/76 |
| 2,239,719 | A | 4/1941 | Jarrett | |
| 2,491,129 | A | 12/1949 | Nieuwsma | |
| D164,705 | S | 10/1951 | Moses | |
| 2,896,910 | A | 7/1959 | Cooper et al. | |
| 2,937,004 | A | 5/1960 | Striani | |
| D192,721 | S | 5/1962 | Mills | |
| 3,134,574 | A | 5/1964 | Reuterfors | |
| 3,219,316 | A | 11/1965 | Fried | 254/131 |
| 3,705,430 | A | 12/1972 | Ziaylek, Jr. | 7/147 |
| D226,162 | S | 1/1973 | Ziaylek et al. | |
| 3,760,656 | A | 9/1973 | Veach | |
| 4,028,757 | A | 6/1977 | Young | |
| 4,039,140 | A | 8/1977 | Pulliam | |
| 4,287,623 | A | 9/1981 | Tarran | |
| 4,408,505 | A | 10/1983 | Cook | |
| D271,275 | S | 11/1983 | Richilano | |
| D274,032 | S | 5/1984 | Lai | |
| 4,476,596 | A | 10/1984 | Fortune | |
| 4,597,123 | A | 7/1986 | Cobe, Jr. | |
| D291,402 | S | 8/1987 | Square | |
| D299,414 | S | 1/1989 | Bajza et al. | D8/105 |
| D300,111 | S | 3/1989 | Square | |
| 4,826,136 | A | 5/1989 | Thomas | |
| D318,211 | S | 7/1991 | D'Onofrio | |
| 5,033,501 | A | 7/1991 | Stehling | |
| 5,044,033 | A | 9/1991 | Fosberg | |
| D337,492 | S | 7/1993 | Ryan et al. | |
| 5,282,287 | A | 2/1994 | Aube | |
| D351,326 | S | 10/1994 | Schwengel | |
| D359,220 | S | 6/1995 | Vinar | |
| 5,428,853 | A | 7/1995 | Menke et al. | |
| 5,456,278 | A | 10/1995 | Morris et al. | |
| D384,264 | S | 9/1997 | Liou | |
| D388,303 | S | 12/1997 | Berggren | |
| D390,082 | S | 2/1998 | Higgs | |
| 5,768,956 | A | 6/1998 | Coonrad | |
| 5,820,107 | A * | 10/1998 | Hall | 254/25 |
| 5,845,354 | A | 12/1998 | Long et al. | |
| 5,850,650 | A | 12/1998 | Karsnia | |
| D404,267 | S | 1/1999 | Hedin | |
| 5,896,607 | A | 4/1999 | Hagen | |
| D414,089 | S | 9/1999 | Kuo-Chen | |
| D420,873 | S | 2/2000 | Hsieh | |
| D422,860 | S | 4/2000 | Vinar | |
| 6,186,475 | B1 | 2/2001 | Selepouchin | |
| 6,220,124 | B1 | 4/2001 | Perkins | |
| D449,770 | S | 10/2001 | Chen | |
| 6,298,754 | B1 | 10/2001 | Brown | |
| 6,352,009 | B1 | 3/2002 | Gaidjiergis | |
| 6,435,059 | B1 | 8/2002 | Martinez | |
| 6,536,308 | B1 * | 3/2003 | Thorne et al. | 81/20 |
| 6,604,728 | B1 | 8/2003 | Boydon | |
| 6,629,684 | B2 * | 10/2003 | Youngren et al. | 254/19 |
| 6,637,061 | B1 | 10/2003 | Spracklin et al. | |
| D496,244 | S | 9/2004 | Boydon | |
| D499,322 | S | 12/2004 | Hung | |
| 6,899,001 | B1 | 5/2005 | Sanders et al. | |
| D507,167 | S | 7/2005 | Richardson | |
| 7,033,365 | B2 | 4/2006 | Powell et al. | |
| D525,506 | S | 7/2006 | Downing, Jr. | |
| D562,101 | S | 2/2008 | Martone | |
| D567,620 | S | 4/2008 | Martone | |
| 2004/0045411 | A1 | 3/2004 | Youngren et al. | |
| 2004/0261188 | A1 | 12/2004 | Mathis | |
| 2006/0075572 | A1 | 4/2006 | Young | |

FOREIGN PATENT DOCUMENTS

| | | |
|---|---|---|
| DE | 202005007075 U1 | 4/2006 |
| GB | 0276509 | 9/1927 |
| GB | 2355223 A | 4/2001 |
| WO | WO 2007/038158 | 4/2007 |

OTHER PUBLICATIONS

European Search Report issued for European Patent Application No. 07251165.2-1262, dated Jul. 27, 2007.

European Search Report from related application 07122268.1, dated Mar. 5, 2008, 7 pgs.

Examination Report issued for EP Patent Application. No. 08158710.7, dated Oct. 2, 2009.

European Search Report, dtd Nov. 3, 2008, in EP Application No. 08158710.7, 7 pp.

Examination Report issued for EP Patent Application No. 08158710.7, dated Dec. 2, 2010.

* cited by examiner

DEMOLITION TOOL

CROSS-REFERENCE TO RELATED APPLICATIONS

This application is a continuation of U.S. patent application Ser. No. 11/391,230 (U.S. Patent Application Publication No. 2007226913), filed Mar. 29, 2006, now U.S. Pat. No. 8,117,702 entitled "Demolition Tool," the contents of which are incorporated herein by reference in their entirety.

BACKGROUND OF THE INVENTION

1. Field of the Invention

The invention relates to a multi-functional demolition tool and methods for the manufacture thereof.

2. Description of Related Art

There are many hand tools that are traditionally used for demolition of construction or building materials. A "crow bar," for instance, typically has a straight pry bar end attached to a long lever arm and a hooked pry bar end at its opposite terminus. Some tools have pry bar ends that are forked for use in removing nails or other fasteners and otherwise wedging into building materials. Additional demolition tools include various sledge hammers, grasping equipment, and other tools.

However, some of these demolition tools present certain drawbacks or limited capabilities. For example, typical board grasping equipment is unsuitable for successfully demolishing lumber or grasping materials or boards of different thicknesses. In addition, certain tools with pry bar ends do not enable full range of motion due to other implements located at opposite ends of the tool bottoming out on a work surface. Furthermore, the configuration of these pry bar ends often interferes with the comfortable use of the implements located at the other ends of the tool.

Other demolition tools are made from material that is not intended to be struck by a striking tool to enable it to be used in a chisel-like manner. Finally, some tools that are used for demolition, but designed for other purposes, are made from multiple parts as opposed to being integrally formed. This adds to the cost and complexity of the structure, and potentially reduces the strength thereof.

BRIEF SUMMARY OF THE INVENTION

The present disclosure relates to a demolition tool for demolishing construction material, building material, or other material. In one embodiment, the demolition tool comprises a handle with a head at a first end of the handle, the head having a longitudinal central plane. In one embodiment, the head includes a strike contact face. The strike contact face includes a flat surface that can be struck by a hammer or other striking tool or that can be used to strike building or other material for demolition purposes or for other purposes. In one embodiment, the plane or surface of the strike contact face is parallel with the main axis of the handle and perpendicular to the longitudinal central plane of the head.

In one embodiment, the head also includes grasping jaws. In one embodiment, the grasping jaws may be utilized to grasp, manipulate, and/or otherwise demolish building materials such as, for example, lumber or other building materials. The grasping jaws include one or more steps on one or both of an upper jaw or a lower jaw. The grasping jaws having one or more steps may form multiple gaps. The multiple gaps may accommodate materials or boards having different thicknesses. In some embodiments, the grasping jaws include one or more teeth on their interior grasping surfaces. In one embodiment, the opening formed by the grasping jaws is perpendicular to the main axis of the handle. In one embodiment, the grasping jaws extend generally along the longitudinal central plane of the head.

In some embodiments, the demolition tool includes a chisel blade on the opposite side of the head from the strike contact face. In one embodiment, the chisel blade is formed as part of the upper jaw of the grasping jaws. The chisel blade may be used to penetrate building materials such as wood (or other materials) for the purposes of demolition or for other purposes.

In one embodiment, the demolition tool includes a bent end pry bar at a second end of the handle. Bent end pry bar may enable the removal of fasteners such as, for example, nails, brads, staples, or other fasteners, or may enable general prying apart of materials. In one embodiment, the bent end pry bar is bent in a direction that is 90 degrees offset from the central longitudinal plane of the head. This offset enables the use of the bent end pry bar without interference from the head or any implements thereon (e.g., the grasping jaws, the strike contact surface, or other implements). Additionally, the 90 degree offset moves the bent end pry bar out of the plane of use of implements on the head.

In one embodiment, the demolition tool includes a blunt blade edge located on the head, below the strike contact face. The blunt blade edge may include a tapered wedge that may be utilized to break apart or otherwise demolish construction materials such as for example, wood, softer metals, or other materials by striking blows upon the material.

The demolition tool, including the handle, the head, the bent end pry bar, and/or other portions of the demolition tool, may comprise a single integrally molded metal material, as opposed to multiple parts jointed or fastened together. In one embodiment, the demolition tool is manufactured to weigh between 3.5 to 4.5 lbs., and in one embodiment, approximately 4 lbs. This weight provides a tool with enough mass and inertia to aid in demolition of construction materials or other materials. In one embodiment, the demolition tool may be hardened to Rockwell C 38-44. Thus, the demolition tool is softer than conventional tools that can be used to strike it, but harder than the materials it is used to strike (e.g., wood, aluminum, or other materials).

These and other objects, features, and advantages of the invention will be apparent through the detailed description of the preferred embodiments and the drawings attached hereto. It is also to be understood that both the foregoing summary and the following detailed description are exemplary and not restrictive of the scope of the invention.

DETAILED DESCRIPTION OF THE INVENTION

Figure 1:
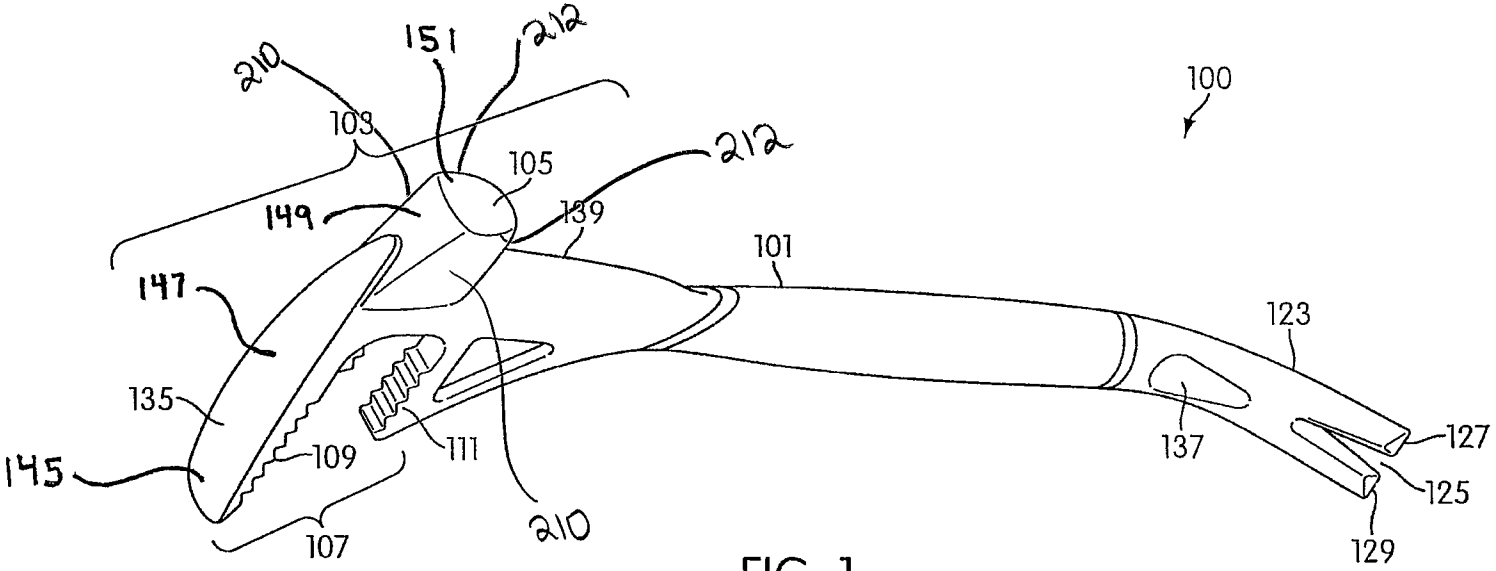
FIG. 1 illustrates a perspective view of a demolition tool according to an embodiment of the invention.
Figure 2:
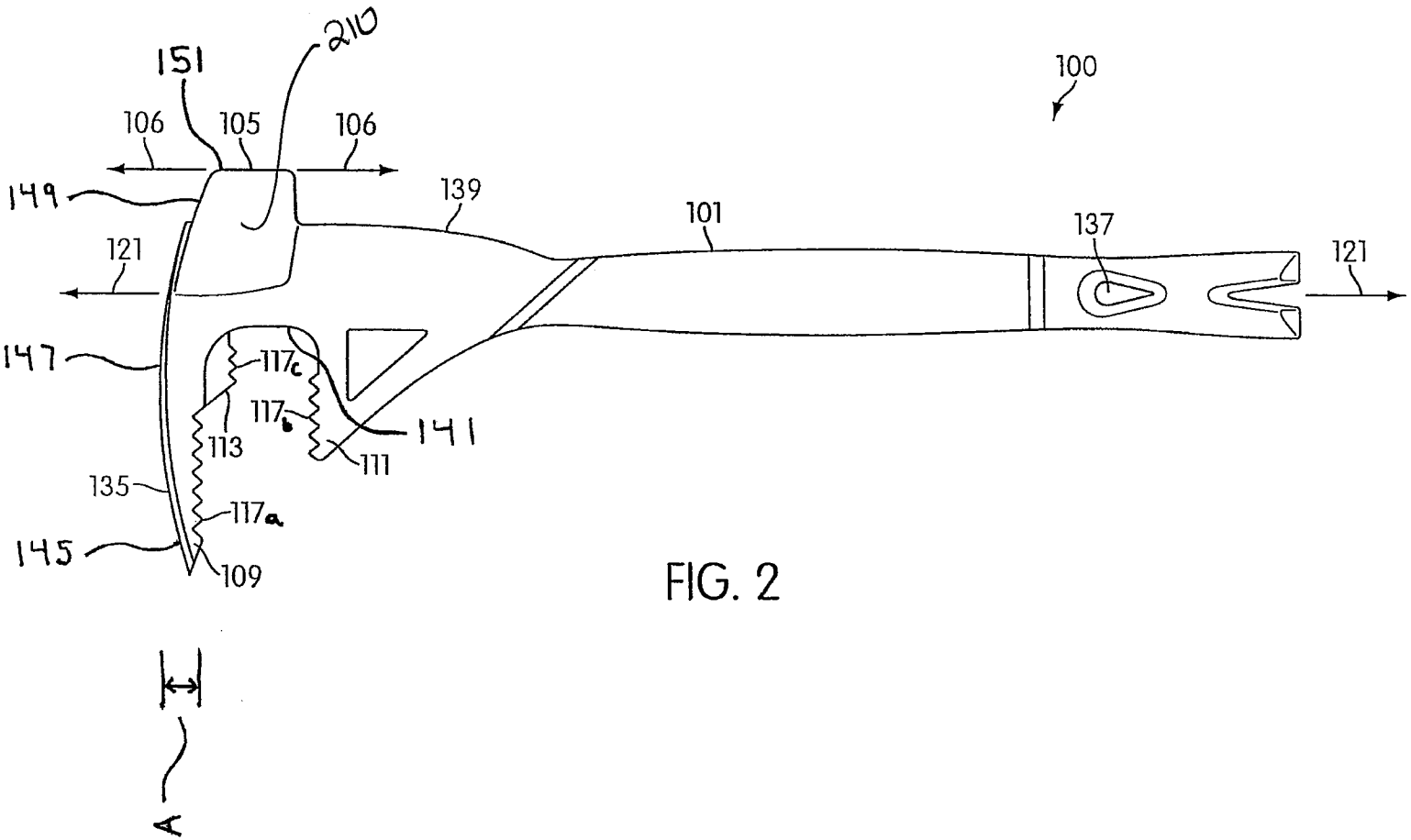
FIG. 2 illustrates a side view of a demolition tool according to an embodiment of the invention.

The invention provides a demolition tool for demolishing construction material, building material, or other material. FIG. 1 illustrates a demolition tool 100 according to an embodiment of the invention. In one embodiment, demolition tool 100 comprises a handle 101 with a head 103 at a first end of handle 101. In one embodiment, head 103 has a longitudinal central plane (plane 131 of FIGS. 4A and 4B) that bisects head 103. In one embodiment, head 103 includes a strike contact face 105. Strike contact face 105 includes a generally flat surface that can be struck by a hammer or other striking tool or that can be used to strike building or other material for demolition purposes or for other purposes. In one embodiment, the plane 106 or surface of strike contact face 105 is parallel with the main axis 121 of handle 101, as illustrated in FIG. 2. As shown in FIGS. 1-5, head 103 includes side surfaces 210 on opposite sides 212 of strike contact face 105.

Figure 3:
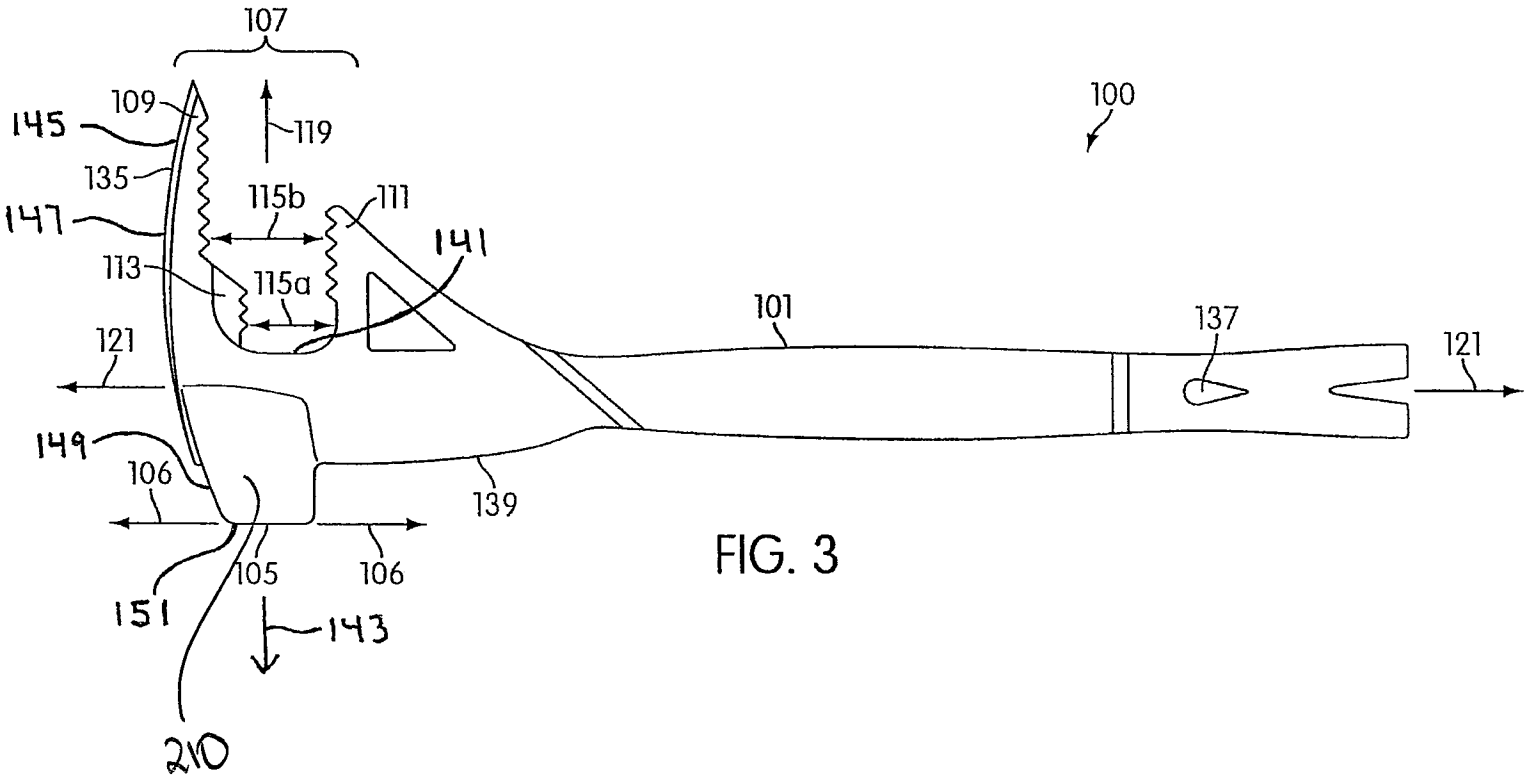
FIG. 3 illustrates a side view of a demolition tool according to an embodiment of the invention.

In one embodiment, head 103 includes grasping jaws 107. In one embodiment, grasping jaws 107 comprise a fixed upper jaw 109 and a fixed lower jaw 111. In some embodiments, upper jaw 109 may have a first set of teeth 117*a* and lower jaw 111 may have a second set of teeth 117*b*, wherein first set of teeth 117*a* are facing and generally parallel to second set of teeth 117*b*. In some embodiments, grasping jaws 107 may be utilized to grasp, manipulate, and/or otherwise demolish building materials such as, for example, lumber or other building materials. Grasping jaws 107 include one or more steps on one or both of upper jaw 109 or lower jaw 111. FIG. 2 illustrates a side view of demolition tool 100 wherein upper jaw 109 includes a single step 113. As shown, step 113 has teeth 117*c*. Grasping jaws 107 having one or more steps may form multiple gaps of different length within grasping jaws 107. For example, FIG. 3 illustrates a side view of demolition tool 100 according to an embodiment of the invention, wherein grasping jaws 107 include multiple gaps 115*a* and 115*b*. The multiple gaps within grasping jaws 107 may accommodate materials having different thicknesses. For instance, in one embodiment, gap 115*a* between step 113 and lower jaw 111 is approximately ¾ inches wide (or perhaps a bit narrower) so that it may accommodate lumber or other material that is ¾ inches thick, while gap 115*b* between upper jaw 109 and lower jaw 111, is approximately 1¼ inches wide (or perhaps a bit narrower) so that it may accommodate lumber or other material that is 1¼ inches thick. Other gaps having other sizes may exist.

In one embodiment, the surface on upper jaw 111 carrying or defining teeth 117*a* is generally parallel to the surface on lower jaw 111 carrying or defining teeth 117*b*. Similarly, the teeth 117*c* on step 113 extend along a line that is generally parallel to the teeth 117*b* on lower jaw 111. Otherwise stated, the points of the teeth 117*b* on the lower jaw 111 are parallel to the points (or lines extending through the points) of the teeth 117*a* on the upper jaw 109 and the points of the teeth 117*c*on step 113. In another embodiment, some of the steps included within grasping jaws 107 do not have teeth. In one embodiment, upper jaw 109 and lower jaw 11 of grasping jaws 107 form an opening that formed by grasping jaws 107 is perpendicular to the main axis 121 of handle 101. FIG. 3 illustrates opening 119, which is perpendicular to the main axis 121 of handle 101. In one embodiment, jaws 107 and the opening 119 formed by grasping jaws 107 extend generally along the longitudinal central plane (i.e., plane 131) of head 103. In some embodiments, opening 119 includes a back end surface 141. In some embodiments, back end-surface 141 is generally parallel to the main axis 121 of handle 101. In some embodiments, strike contact face 105 faces a direction 143 that is generally opposite the direction of opening 119.

Demolition tool 100 includes a chisel blade 135, on the opposite side of head 103 from strike contact face 105, as illustrated in FIGS. 1-4*b*. In one embodiment, chisel blade 135 is formed upon upper jaw 109 of grasping jaws 107. In some embodiments, upper jaw 109 includes a rearward end portion 145 having a height that tapers to become narrower as it extends towards a rearward end thereof (i.e., as it generally extends away from the strike contact face). An example of the height of rearward end portion 145 is illustrated as "item A" on FIG. 2. It will be appreciated that the height of rearward end portion 145 may vary from that illustrated in item A with the specific portion of upper jaw 109 under consideration. Furthermore, head 103 may include an upper surface portion 147 that has a generally arcuate configuration (see FIGS. 2 and 3) that meets an upper portion 151 of strike contact face 105. In some embodiments, the front end 149 arcs downwardly to meet strike face 105. In some embodiments, upper surface portion 147 may have a width that tapers to as to become narrower as it extends towards front end 149. An example of the width of upper surface 147 is illustrated as "item B" on FIG. 4A. It will be appreciated that the specific width of upper surface 147 may vary from that illustrated in item B with the specific portion of upper jaw 109 under consideration. Chisel blade 135 may be used to penetrate building materials such as wood (or other materials) for the purposes of demolition or for other purposes. In one embodiment, chisel blade 135 may be positioned on a workpiece to be penetrated, and the strike contact face 105 may be struck by a hammer or other striking tool, such that chisel blade 135 is driven into the workpiece.

Figure 4A:
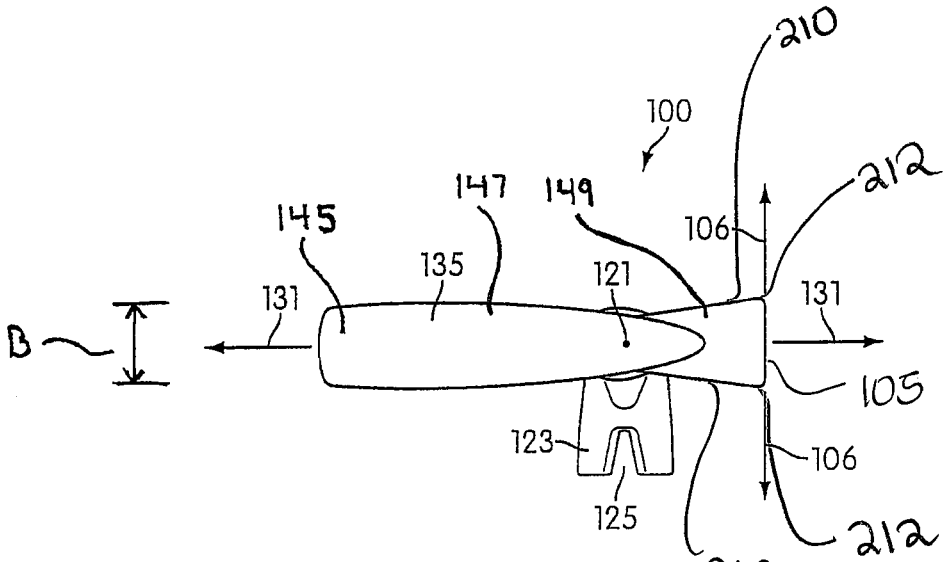
FIG. 4A illustrates an end view of a demolition tool according to an embodiment of the invention.
Figure 4B:
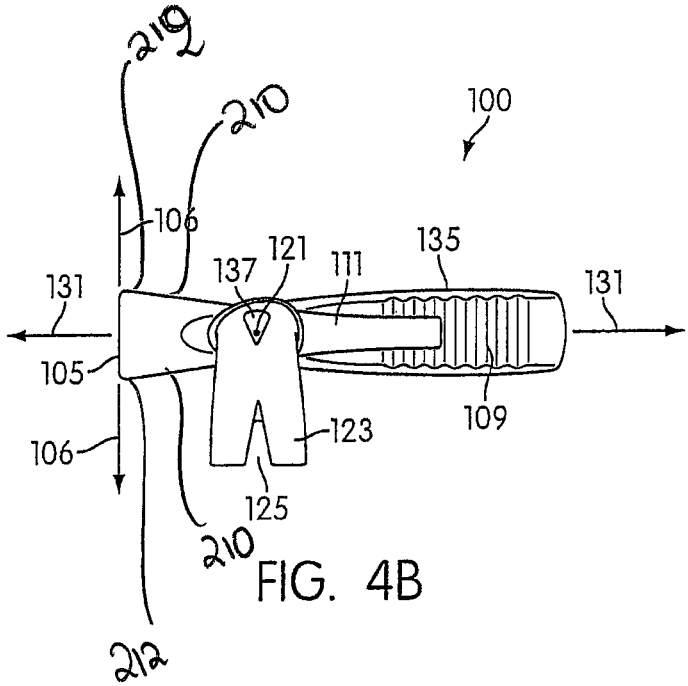
FIG. 4B illustrates an end view of a demolition tool according to an embodiment of the invention.
Figure 5:
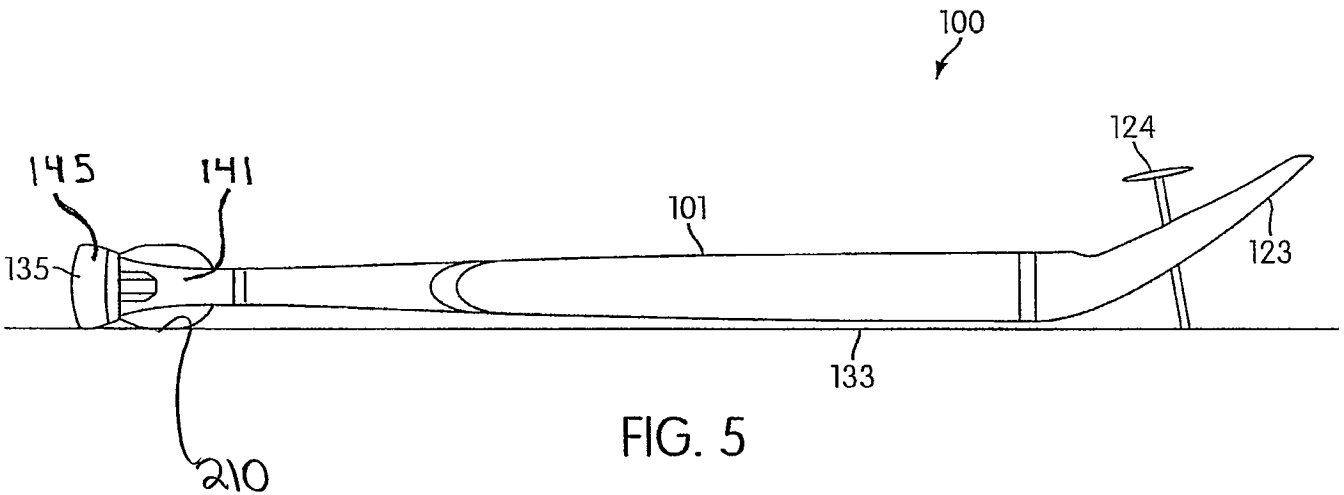
FIG. 5 illustrates a side view of a demolition tool according to an embodiment of the invention.

In one embodiment, demolition tool 100 includes a bent end pry bar 123 at a second end of handle 101. In some embodiments, bent end pry bar 123 includes a forked end having a V-shaped gap 125 in between tapered ends 127 and 129. The bent end pry bar 123 may enable the removal of fasteners such as, for example, nails, brads, staples, or other fasteners from a workpiece or may enable general prying apart of materials. FIG. 5 illustrates a side view of demolition tool 100 according to an embodiment of the invention, wherein pry bar 123 is being used to remove or pry a fastener (e.g., nail) 124 from a planar work surface 133. In one embodiment, as shown in FIG. 5, bent pry bar 123 is bent in a direction that is generally perpendicular to the longitudinal central plane 131 (as shown in FIGS. 4A and 4B) of the head 103. As also shown, the head 103 and pry bar 123 are arranged so that one of the side surfaces 210 of the head 103 will contact the planar work surface 133 at the end of prying the nail from the work surface 133 when the prying is continued to a maximum extent.

In one embodiment, bent end pry bar 123 is bent in a direction that is 90 degrees offset or generally perpendicular from plane 131 that bisects the head 103. FIGS. 4A and 4B illustrate end views of demolition tool 100 according to an embodiment of the invention, wherein bent end pry bar 123 is offset 90 degrees from plane 131 of head 103. This offset enables the use of bent end pry bar 123 without interference from head 103 or any implements thereon (e.g., grasping jaws 107, strike contact surface 105, or other implements). For example, bent end pry bar may be used to pry material or remove a fastener on a flat work surface (such as work surface 133 in FIG. 5) without head 103 causing demolition tool 101 to prematurely bottom out on work surface 133. A user may utilize the full range of motion bent end pry bar 123 to pry until head 103 bottoms out on work surface 133. Additionally, the 90 degree offset moves bent end pry bar 123 out of the plane of use of implements on head 103.

In one embodiment, demolition tool 100 includes an opening 137. Opening 137 may include a hole extending completely through the width of demolition tool 100. FIGS. 1-3 and 4B illustrate demolition tool 100 having opening 137 according to an embodiment of the invention. In some embodiments opening 137 is located on handle 101, on bent end pry bar 123, between bent end pry bar 123 and handle 101, or in another location on demolition tool 100. In some embodiments, opening 137 is a tear-dropped-shaped opening and enables the removal of nails, brads, or other fasteners from building materials or other materials. Opening 137 may be beveled on one or both sides (FIG. 2 illustrates a beveled side of opening 137).

Figure 6:
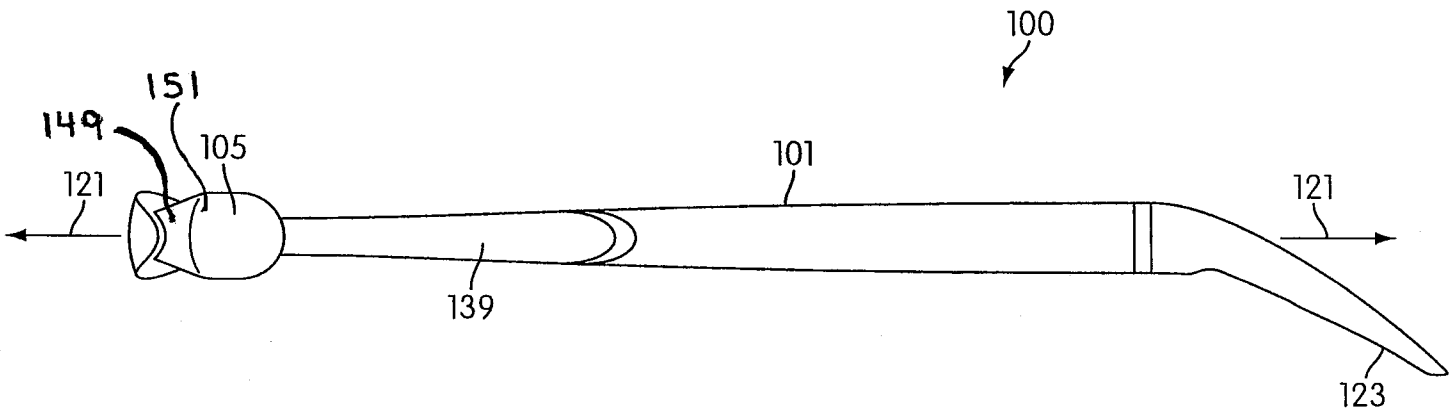
FIG. 6 illustrates a side view of a demolition tool according to an embodiment of the invention.

In one embodiment, demolition tool 100 includes a blunt blade edge 139. FIGS. 1-3 illustrate an embodiment of demolition tool 100 wherein blunt blade edge 139 is located on head 103, below strike contact face 105. FIG. 6 illustrates a side view of demolition tool 100 according to an embodiment of the invention, wherein blunt blade edge 139 is parallel to the main axis 121 of handle 101. In one embodiment, blunt blade edge 139 may exist on the same plane as the longitudinal central plane (i.e., plane 131) of head 103. Blunt blade edge 139 may include a tapered wedge that may be utilized to break apart or otherwise demolish construction materials such as for example, wood, metals, or other materials by striking blows upon the material. In some embodiments, blunt blade edge 139 is blunt enough such that it does not cut material in the same fashion as a knife, axe, or other sharp bladed tool. In other embodiments, blunt blade edge 139 has a sharp edge such as, for example, an edge similar to an axe or hatchet blade.

In one embodiment, demolition tool 100, including handle 101, head 103, bent end pry bar 123, and/or other portions of demolition tool 100, comprise a single integrally forged or molded metal material, as opposed to being formed from multiple parts jointed or fastened together.

In one embodiment, demolition tool 100 includes a grip material such as, for example, rubber, plastic, or other material on handle 101 or other portions of demolition tool 101. The gripping material may be placed over or secured to demolition tool 100 to aid in its use as a hand tool by providing a slip resistant and comfortable grip for a user's hands. In one embodiment, demolition tool 100 is manufactured to weigh approximately 3.5-4.5 lbs. and may weigh approximately 4 lbs.

As mentioned above, demolition tool 100 may be utilized in the demolition of construction or building materials. For example, demolition tool 100 may be utilized to break apart or otherwise demolish a workpiece when chisel blade 135 is placed on the workpiece and strike contact face 105 is struck by a hammer or other tool, thus, driving chisel blade 135 into the workpiece. Typically, striking tools, such as hammer heads are hardened to minimum hardness of Rockwell C 45 As such, tools or fasteners that are meant to be struck are hardened to a maximum hardness that is less than Rockwell C 45. As stated above, strike contact face 105 of the demolition tool may be struck by a hammer or striking tool to enable demolition tool 100 to be used as a chisel. As such, in one embodiment, strike contact face 105 or the entirety of demolition tool 100 may be hardened to Rockwell C 38-44. Thus, demolition tool 100 will be softer than tools used to strike it, but harder than the materials it will be used to demolish (e.g., wood, aluminum, or other materials).

To achieve a hardness of Rockwell C 38-44, certain manufacturing techniques are used. In one embodiment, demolition tool 100 is integrally formed (e.g., forged or molded) of steel and a two step heat treating process is utilized. First, demolition tool is hardened by heating the steel to between 810° C. to 870° C., and in one embodiment, between 830° C. to 850° C., and in one embodiment, approximately 840° C. At 840° C., the heat treatment temperature is maintained between 60-80 minutes, and in one embodiment, 70 minutes. After heat treatment, the tool is quenched in oil to rapidly cool to tool. At this point the steel is both hard and brittle. The second step of the process is to temper the steel, which reduces the hardness but adds toughness to the steel. Tempering is performed by heating the steel a second time to between 380° C. and 420° C., and in one embodiment, between 390° C. and 410° C., and in one embodiment, 400° C. The steel is then soaked at that temperature for between 140 and 160 minutes, and in one embodiment, 150 minutes.

In one embodiment, it is contemplated that FIGS. 1-6 are drawn to scale (i.e., not to actual size, but in proportion).

While the invention has been described with reference to the certain illustrated embodiments, the words that have been used herein are words of description, rather than words of limitation. Changes may be made, within the purview of the associated claims, without departing from the scope and spirit of the invention in its aspects. Although the invention has been described herein with reference to particular structures, acts, and materials, the invention is not to be limited to the particulars disclosed, but rather can be embodied in a wide variety of forms, some of which may be quite different from those of the disclosed embodiments, and extends to all equivalent structures, acts, and, materials, such as are within the scope of the associated claims.

What is claimed is:

1. A multi-use demolition tool, comprising:

a handle having a longitudinal axis;

a head integrally formed with an upper portion of the handle, the head including a strike face, the head including side surfaces on opposite sides of the strike face;

a bent pry bar located at a bottom end of the handle; and fixed board grasping jaws located on the head including a fixed upper jaw having a first set of teeth and a fixed lower jaw having a second set of teeth, the first set of teeth facing and being generally parallel to the second set of teeth, the parallel first and second set of teeth being generally perpendicular to the longitudinal axis;

wherein the fixed upper jaw and the fixed lower jaw form an opening facing a first direction generally-perpendicular to the longitudinal axis of the handle, wherein the strike face faces a second direction opposite the first direction, wherein the upper jaw has a rearward portion having a height that tapers so as to become narrower as it extends toward the first direction, wherein an upper surface portion of the head has an arcuate configuration, wherein the bent pry bar has a teardrop shaped opening constructed and arranged to pry a nail from a planar work surface, the bent pry bar being bent in a direction that is generally perpendicular to a longitudinal central plane of the head, the head and pry bar arranged so that one of the side surfaces of the head will contact the planar work surface at the end of prying the nail from the work surface when the prying is continued to a maximum extent, and wherein the fixed lower jaw has a thickness smaller than a thickness of the fixed upper jaw.

2. The demolition tool of claim 1, wherein at least the strike face has a hardness of between Rockwell C 38 and Rockwell C 44.

3. The demolition tool of claim 1, further comprising a blunt blade comprising a tapered wedge located on the head below the strike face, wherein a leading edge of the blunt blade is parallel with a longitudinal central plane of the head and is parallel to a main axis of the handle.

4. The demolition tool of claim 1, wherein the fixed upper jaw includes at least one step thereon, such that the fixed board grasping jaws form multiple gaps, each gap having a different width, wherein the at least one step includes one or more teeth.

5. The demolition tool of claim 1, wherein the upper surface portion of the head having an arcuate configuration arcs downward to meet an upper portion of the strike face.

6. A multi-use demolition tool, comprising:

a handle having a longitudinal axis;

a head integrally formed with an upper portion of the handle, the head including a strike face, the head including side surfaces on opposite sides of the strike face, the head having fixed board grasping jaws including a fixed upper jaw having a first set of teeth and a fixed lower jaw having a second set of teeth, the first set of teeth facing and being generally parallel to the second set of teeth, the parallel first and second set of teeth being generally perpendicular to the longitudinal axis, wherein the fixed upper jaw and the fixed lower jaw form an opening facing a first direction, the strike face facing a second direction generally opposite the first direction, wherein the upper jaw has a rearward end portion having a height that tapers so as to become narrower as it extends toward the first direction, and wherein an upper surface portion of the head has an arcuate configuration; and a bent pry bar located at a bottom end of the handle, wherein the bent pry bar includes a teardrop shaped opening positioned between the bottom end of the handle and a bottom end of the bent pry bar, and the teardrop shaped opening constructed and arranged to pry a nail from a planar work surface, wherein the bent pry bar is bent in a direction that is generally perpendicular to a longitudinal central plane of the head, the head and pry bar arranged so that one of the side surfaces of the head will contact the planar work surface at the end of prying the nail from the work surface when the prying is continued to a maximum extent, and wherein the fixed lower jaw has a thickness smaller than a thickness of the fixed upper jaw.

7. The demolition tool of claim 6, wherein at least the strike face has a hardness of between Rockwell C 38 and Rockwell C 44.

8. The demolition tool of claim 6, wherein the upper surface portion of the head has a width that tapers so as to become narrower toward the front end thereof.

9. The demolition tool of claim 6, wherein the fixed upper jaw includes at least one step thereon, such that the fixed board grasping jaws form multiple gaps, each gap having a different width, wherein the at least one step includes one or more teeth.

10. A multi-use demolition tool, comprising:

a handle;

a head located at a first end of the handle;

a strike face located on the head facing a first direction, the head including side surfaces on opposite sides of the strike face;

a blunt blade located below the strike face;

spaced upper and lower jaws defining an opening facing a direction opposite the first direction, wherein each of the upper and lower jaws include at least one surface having a plurality of teeth thereon; and a pry bar having a forked end located at a second end of the handle, the pry bar constructed and arranged to pry a nail from a planar work surface, wherein the pry bar has a teardrop-shaped opening located between the first end of the handle and the forked end of the pry bar, the pry bar being bent in a direction that is generally perpendicular to a longitudinal central plane of the head, the head and pry bar arranged so that one of the side surfaces of the head will contact the planar work surface at the end of prying the nail from the work surface when the prying is continued to a maximum extent.

11. The demolition tool of claim 10, wherein the upper jaw has a height that tapers to become narrower at an end of the upper jaw opposite to the strike face.

12. The demolition tool of claim 10, wherein upper surface of the head has an arcuate configuration.

13. The demolition tool of claim 10, wherein the lower jaw comprises a triangular shape.

14. A multi-use demolition tool, comprising:

a handle, a grip material formed on the handle;

a head integrally formed with an upper portion of the handle, the head including a strike face and side surfaces on opposite sides of the strike face;

a blunt blade formed on the head below the strike face;

a bent pry bar located at a bottom end of the handle, the bent pry bar constructed and arranged to pry a nail from a planar work surface; and fixed board grasping jaws located on the head including a fixed upper jaw having a first set of teeth and a fixed lower jaw having a second set of teeth, the first set of teeth facing and being generally parallel to the second set of teeth, wherein the fixed upper jaw and the fixed lower jaw form an opening facing a first direction generally perpendicular to a longitudinal axis of the handle, wherein the strike face faces a second direction opposite the first direction, wherein the upper jaw has a rearward portion having a height that tapers so as to become narrower as it extends toward the first direction, wherein an upper surface portion of the head has an arcuate configuration, and wherein the bent pry bar has a teardrop-shaped opening, the bent pry bar being bent in a direction that is generally perpendicular to a longitudinal central plane of the head, the head and pry bar arranged so that one of the side surfaces of the head will contact the planar work surface at the end of prying the nail from the work surface when the prying is continued to a maximum extent.

15. A multi-use demolition tool, comprising:

a handle;

a head integrally formed with an upper portion of the handle, the head including a strike face, the head including side surfaces on opposite sides of the strike face, the head having fixed board grasping jaws including a fixed upper jaw having a first set of teeth and a fixed lower jaw having a second set of teeth, the first set of teeth facing and being generally parallel to the second set of teeth, wherein the fixed upper jaw and the fixed lower jaw form an opening facing a first direction, the strike face facing a second direction generally opposite the first direction, wherein the upper jaw has a rearward end portion having a height that tapers so as to become narrower as it extends toward the first direction;

a blunt blade formed on the head below the strike face; and a bent pry bar located at a bottom end of the handle, wherein the bent pry bar includes a teardrop shaped opening positioned between the bottom end of the handle and a bottom end of the bent pry bar, the bent pry bar constructed and arranged to pry a nail from a planar work surface, wherein the pry bar being bent in a direction that is generally perpendicular to a longitudinal central plane of the head, the head and pry bar arranged so that one of the side surfaces of the head will contact the planar work surface at the end of prying the nail from the work surface when the prying is continued to a maximum extent.

* * * * *

UNITED STATES PATENT AND TRADEMARK OFFICE

CERTIFICATE OF CORRECTION

PATENT NO. : 8,585,016 B2
APPLICATION NO. : 12/233715
DATED : November 19, 2013
INVENTOR(S) : Christopher Woolley et al.

It is certified that error appears in the above-identified patent and that said Letters Patent is hereby corrected as shown below:

On title page, item (75) Inventors
replace "Michael Maruskiak"
with --Michael Marusiak--.

Signed and Sealed this
Fifteenth Day of July, 2014

Michelle K. Lee

Michelle K. Lee
*Deputy Director of the United States Patent and Trademark Office*